US005791956A

United States Patent [19]

Smith

[11] Patent Number: 5,791,956

[45] Date of Patent: Aug. 11, 1998

[54] DIVERS SAFETY DEVICE

[76] Inventor: Michael C. Smith, 28 The Avenue, St. Pauls Cray, Orpington, Kent, United Kingdom, BR5 3JD

[21] Appl. No.: 795,438

[22] Filed: Feb. 5, 1997

[51] Int. Cl.[6] ..... B63C 9/08

[52] U.S. Cl. ..... 441/6; 441/89; 441/92

[58] Field of Search ..... 441/1, 6, 10, 11, 441/12, 13, 16, 30, 89, 92; 116/210; 405/186; 128/204.23, 716; 340/573, 606

[56] References Cited

U.S. PATENT DOCUMENTS

| | | | |
|---|---|---|---|
| 3,798,629 | 3/1974 | De La Taillade et al. | 128/716 |
| 3,871,044 | 3/1975 | Wedrall . | |
| 4,080,677 | 3/1978 | Koehler . | |
| 4,186,374 | 1/1980 | Oullette | 441/11 |
| 5,022,790 | 6/1991 | Stevenson | 441/89 |
| 5,029,293 | 7/1991 | Fontanille | 441/89 |
| 5,326,297 | 7/1994 | Loughlin | 441/89 |
| 5,328,298 | 7/1994 | Maffatone . | |
| 5,403,219 | 4/1995 | Ryan . | |

FOREIGN PATENT DOCUMENTS 0 034 569 2/1981 European Pat. Off. .

*Primary Examiner*—Stephen Avila

*Attorney, Agent, or Firm*—Townsend and Townsend and Crew

[57] ABSTRACT

A safety device to be worn by a diver includes means for monitoring the breathing of the diver and causing release and inflation of a surface marker buoy attached thereto by a line if it detects he has stopped breathing. The monitoring means may also be operable to cause release of a cover of the device allowing the surface marker buoy to rise or the cover may be a simple friction fit pushed aside by the inflating marker buoy. The monitoring means includes a transducer monitoring the pressure of gas breathed, or the flow of gas inhaled or exhaled, by a diver. Various forms of electrical and electro-mechanical logic circuits are described, each of which provides for the comparison over pre-set or pre-settable time intervals of measurements made of gas pressure or flow rate values with pre-set values or with earlier recorded values. The device may be incorporated in the divers breathing equipment or be separate from the equipment but linked to the equipment by a flexible connection. The line has a breaking strain enabling a diver to be pulled to the surface by any associate or assistant on the surface. A radio beacon may be activated and a marker dye released when the buoy is deployed. Switches are provided disabling operation of the device at less than a predetermined depth and allowing the diver to prevent and/or trigger operation of the device.

16 Claims, 4 Drawing Sheets

DIVERS SAFETY DEVICE

DESCRIPTION

Figure 1:
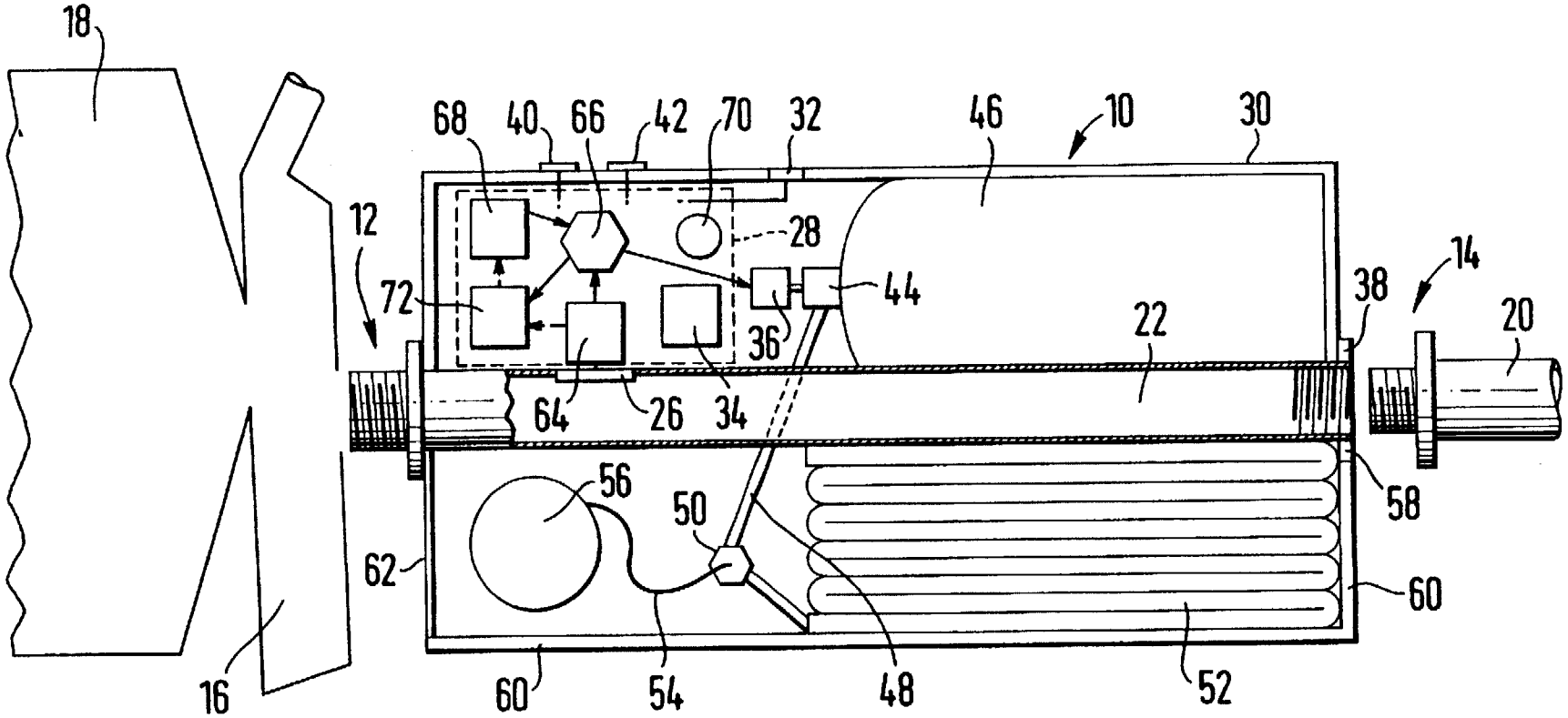

The present invention relates to divers safety devices, in particular devices to be worn by divers operating below the surface of water and supplied with gas from a tank or any self contained apparatus enabling him to breath.

There are many dangers when diving beneath the surface of the water which can cause death or permanent disablement to divers.

One particular difficulty which is encountered is that should the diver, for any reason, cease to breathe whilst under water he will rapidly loose consciousness and may die without surfacing. The fact that a diver has ceased to breathe may not be apparent to any assistant he has on the surface of the water or with him in the water.

It is an object of the invention to provide a device which may be worn by a diver and which will alleviate this difficulty.

In meeting this object the invention provides a safety device to be worn by a diver, which device comprises means for monitoring the breathing of the diver and which upon detecting the diver has stopped breathing causing inflation of a surface marker buoy attached to the device by a line.

The monitoring means may include a transducer monitoring the pressure of a stored gas being breathed by the diver.

In such an arrangement the anticipated pressure difference is of the order of 35 KPa., (5 psi.).

Alternatively the monitoring means may include a transducer monitoring the flow of gas passed to or exhaled by a diver.

The output of the transducer is preferably arranged to increase the count held in a first register the value of which count is compared at pre-set intervals with a second value under the control of a timer.

The output of the transducer may be fed to the first register in a sense to increase the count therein, and comparator means be provided and operable at intervals determined by a timer to compare the count value of the first register with that held in a second register, and, if when compared those values differ by more than a predetermined amount provide a first output causing the value of the first register to be read into the second register, or, if when compared those values differ by less than said predetermined amount to cause a compressed gas supply to be coupled to the surface marker buoy.

The output of the transducer may be fed to the first register in a sense to increase the count therein, and comparator means be provided and operable at intervals determined by a timer to compare the count value of the first register with zero, and, if when compared the count value of the first register is greater than a pre-determined amount to provide a first output causing the count value of the first register to be re-set to zero, or, if when compared the count value of the first register is less than a pre-determined amount to cause a compressed gas supply to be coupled to a surface marker buoy.

The output of the transducer may be fed to the register in a sense to increase the count therein, and the output of a pulse generator be fed to said register in a sense to decrease the count therein and comparator means be provided and operable at intervals determined by a timer compare the count value of the register with a pre-set value and, if when compared the count value of the register is less than the pre-set value to cause a compressed gas supply to be coupled to a surface marker buoy, or, if when compared the count value of the register is greater than the pre-set value to cause the register to be re-set to a zero count value.

The monitoring means may monitor the pressure of gas being supplied to the diver and comprise first and second chambers to which the gas supplied to the diver is coupled, valve means being provided to separate the chambers when the gas pressure in them is equal, a difference between the pressure in the first and the second chambers causing actuation of a switch re-setting a timer which is arranged after a pre-set time interval to cause a compressed gas supply to be coupled to the surface marker buoy.

The transducer may be located within a passage of the device for connecting the scuba first stage to the pressure hose of the divers breathing equipment.

The transducer may be a gas pressure monitor and be within the body of the device which is flexibly coupled by a gas pressure tight line to the divers breathing apparatus.

Alternatively, the transducer may be spaced from and electrically connected to the remainder of the device by a flexible cable.

The monitoring means may be operable to cause release of a cover of the device allowing the surface marker buoy to rise.

The line attaching the buoy to the device preferably has a breaking strain sufficient to enable a diver to be pulled to the surface by any associate or assistant on the surface.

A radio beacon is preferably provided which is activated when the surface marker buoy is released.

Desirably, means enabling release of a marker dye when the surface marker buoy is released.

Preferably, the device further includes a switch operable to disable operation of the device until the diver has submerged to a predetermined depth.

Desirably, switch means are provided which are manually operable by the diver to prevent and/or trigger operation of the device.

Figure 2:
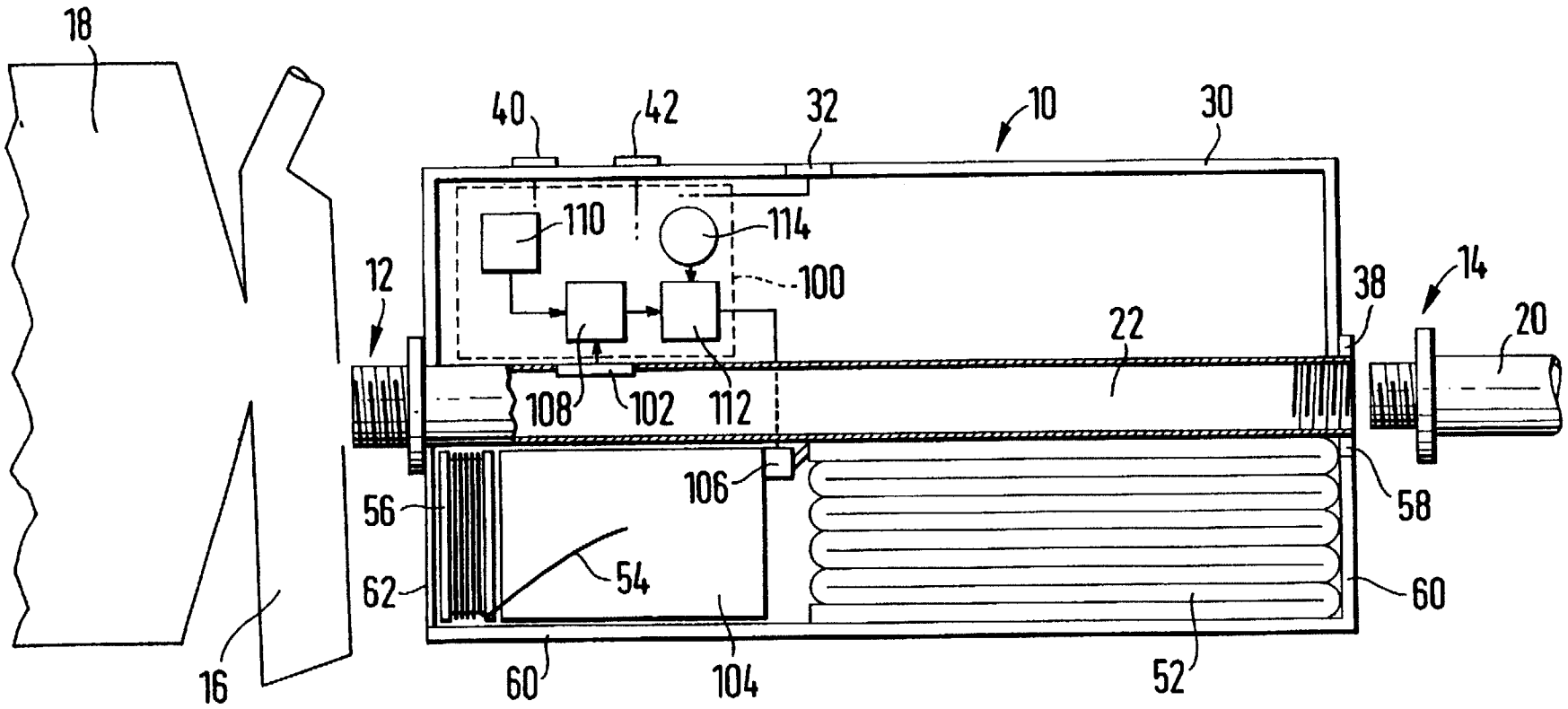
Figure 3:
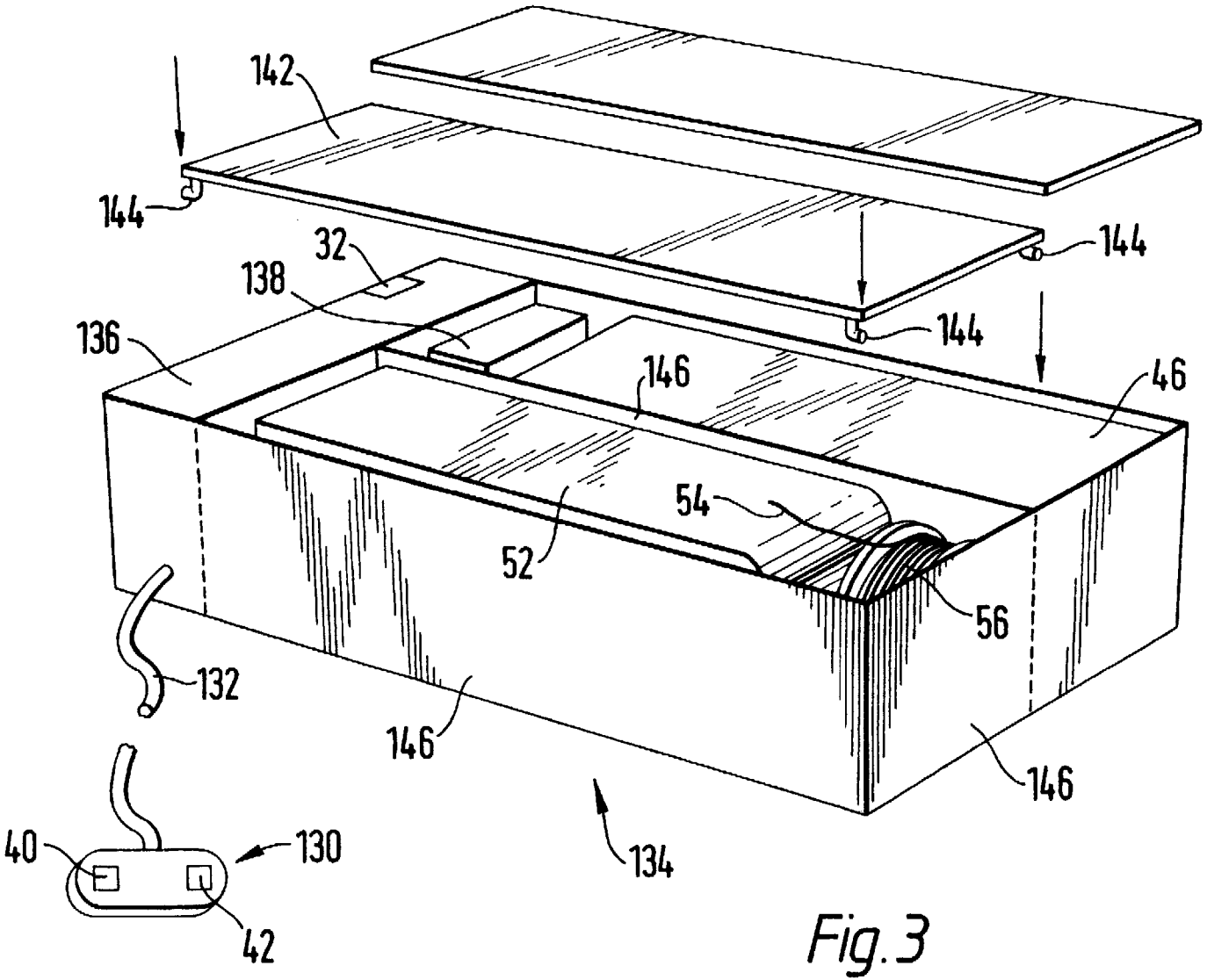
Figure 4:
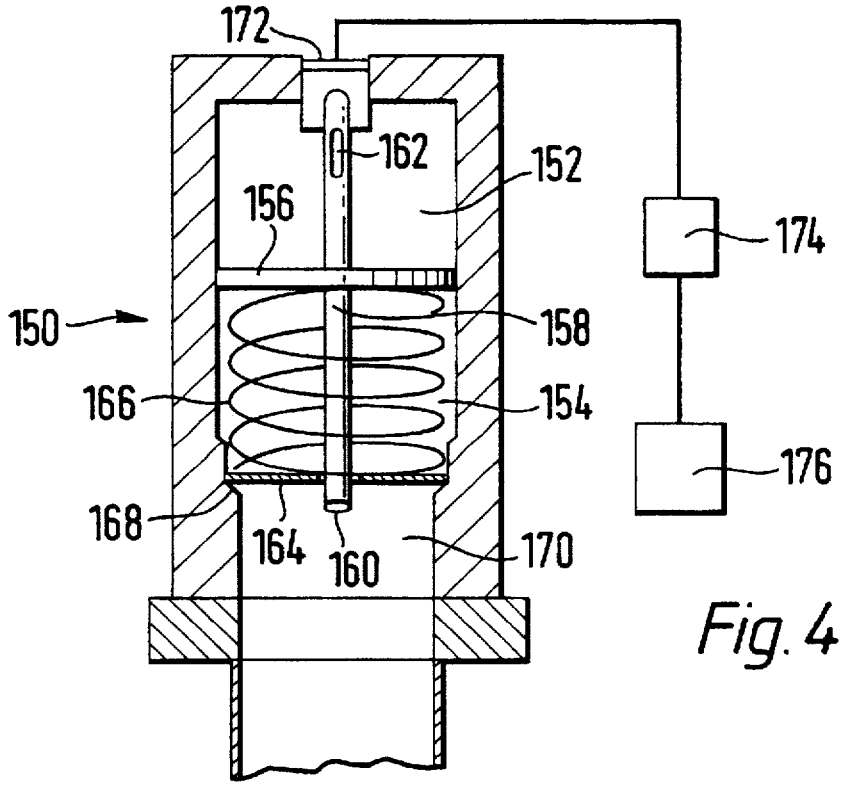
Figure 5:
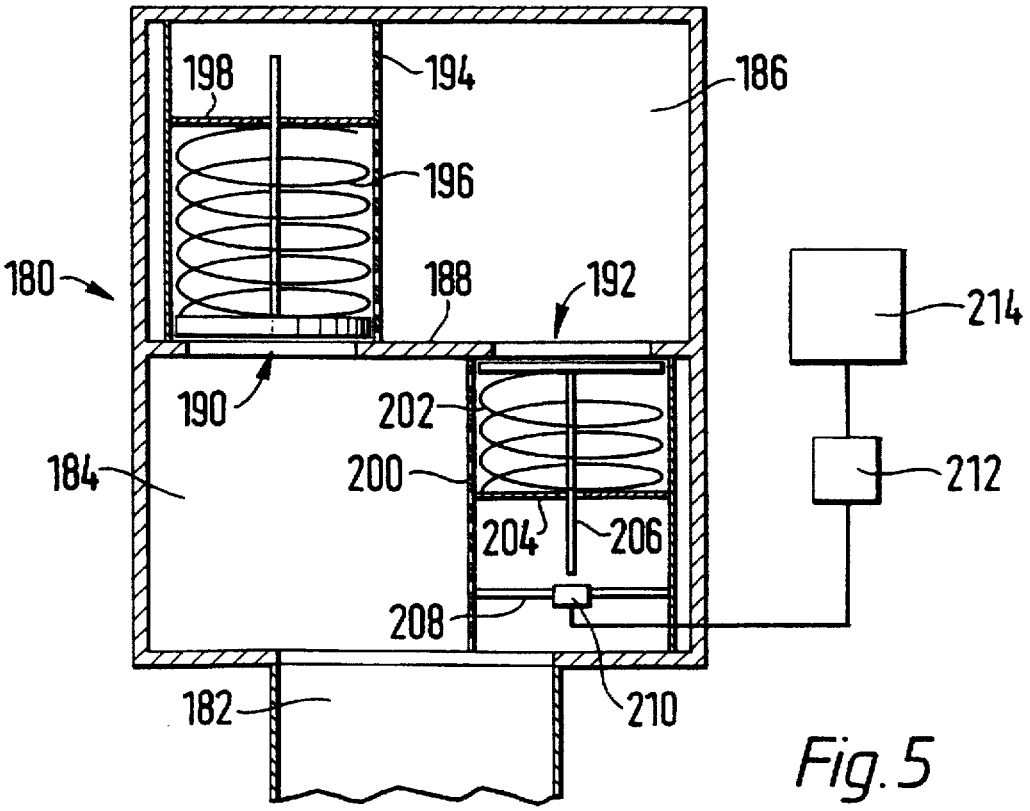

Embodiments of the invention will now be described with reference to the accompanying drawings in which:

FIGS. 1, 2 and 3 illustrate schematically different devices embodying the invention, and FIGS. 4 and 5 illustrate alternative forms of monitoring means which may be used in devices embodying the invention.

FIG. 1 shows a first embodiment of the invention to comprise a casing 10 fitted with couplings 12 and 14 enabling fitment of the device between a scuba first stage 16 which is attached to a gas tank 18 usable by a diver and the normal high pressure hose 20 feeding gas from the tank 18 to the divers own high pressure gauge or monitor (not shown).

The casing is provided with a through bore 22 along which gas from tank 18 passes in use to the high pressure hose 20.

In the wall of the through bore 22 there is mounted a transducer in the form of a gas pressure gauge 26 having a digitised electric output which is taken to logic circuitry 28.

As viewed in FIG. 1 the upper part of the casing 10 is provided as a water resistant wall 30 pressure protected up to, preferably, 1450 KPa., (210 psi.). Wall 30 supports a pressure switch 32 opening to the outside of the device and operable to enable the logic circuitry 28. A battery 34 provides to power the logic circuitry 28, switch 32, a servo-mechanism 36, a magnetic switch 38 adjacent coupling 14 and two other switches 40 and 42 operable by a diver respectively to disable and trigger operation of servo-mechanism 36.

Servo-mechanism 36 controls tap 44 of a compressed gas bottle 46 coupled by a pipe 48 to a gas valve 50 which, when tap 44 is open, feeds gas from the bottle 46 to a surface marker buoy 52.

Surface marker buoy 52 is of a type sold under the Trade Name LEYMO and provides, when inflated, a five meter (15') long generally "sausage" shaped balloon or buoy including an over-pressure relief valve.

Valve 50 is sensitive to the pressure in the buoy 52 and is arranged to automatically detach itself from pipe 48 when the buoy has been fully inflated (e.g. when the pressure in the buoy activates the over-pressure relief valve therein).

The body of the valve 50 has fixed to it one end of a line 54 mounted on a reel 56 held within the device. The other end of line 54 is fixed to reel 56. Line 54 is preferably 100 m (330') in length and has a breaking strain 2200N (500 lbf) or more.

Magnetic switch 38 is normally operable to hold a pin 58 such that it maintains in position a releasable cover part 60 of the safety device. Cover part 60 extends from pin 58 to a hinged lid part 62 covering the reel 56 at the end of the casing 10 normally coupled to the diver's gas tank 18, by way of the first stage 16 of the scuba apparatus, in use.

Operation of the device is as follows:

The device is fixed between the scuba first stage 16 which is attached to the gas tank 18 and the high pressure hose line 20 worn by the diver and forms part of the divers breathing apparatus.

Pressure switch 32 is operable to disable operation of logical circuitry 28 until the diver reaches a depth of 2 m (6') or more.

Thereafter the pressure gauge 26 monitors the gas pressure in bore 22 and its output is taken to the logic circuitry 28.

In the logic circuitry of this particular embodiment the output of transducer 26 is fed to a first register 64 in a sense to increase the count therein and that count value is compared, by a comparator 66, with the count value of a second register 68. This comparison is made under the control of a timer 70 which also controls the timing at which the output of pressure gauge 26 is read to register 64.

If the values held in the registers 64 and 68 differ by more than a predetermined minimum amount comparator 66 provides a first output to a device 72 causing the value in the register 68 to be overwritten by the value held in the register 64.

It is envisaged the clock 70 will cause comparisons to be made of the values in registers 64 and 68 at 30 second intervals.

It will be seen that if the values differ by more than a minimum predetermined amount equivalent, say, to 35 KPa. (5 psi) it is an indication the diver is breathing. However, it will also be seen that if the values held in the registers 64 and 68 are essentially the same (or differ by less than the predetermined amount) it is likely the diver has stopped breathing.

In this circumstance comparator 66 provides a second output signal causing energisation of the servo-mechanism 36 and actuation of the magnetic switch 38.

At this time the cover part 60 is freed, and tap 44 opens allowing gas to flow from the cylinder 46, via pipe 48 and valve 50, to the surface marker buoy 52. Valve 50 is operable, as soon as the surface marker buoy has been fully inflated, to detach itself from the pipe 48 allowing the buoy to float free. Line 54 is played out from reel 56 allowing the buoy 52 to ascend to the surface.

The buoy will inscribed on its outer surface international distress signals as well as words indicating the divers situation and therefore it will immediately be apparent to any assistant on the surface that the diver wearing the safety device has ceased breathing and action can then be taken to enable his or her recovery by directly pulling on the line to bring the diver to the surface, or by guiding other divers to the diver in distress enabling them to provide underwater assistance.

Should the diver find himself in difficulties and the device not have energised he may actuate switch 42 to trigger operation of the device. Likewise if he should have reason not to wish to allow the device to operate when not using his breathing apparatus (e.g. he is using a "buddy system" with another diver) he may disable the device by actuating switch 40.

The transducer output may be an analogue electrical signal coupled to register 64 by an analogue to digital convertor.

FIG. 2 schematically illustrates an alternative arrangement embodying the invention in which parts similar to those already described are given the same reference numeral.

The device may be positioned between the scuba first stage 16 and the air/gas outlet 20 to the diver (as indicated) or between the divers exhaust or return to the breathing apparatus.

In the arrangement of FIG. 2 casing 10 houses logic circuitry 100 which receives the output of a transducer in the form of a gas flow meter 102 monitoring the flow of gas along bore 22 of the device. The output of flow meter 102 is digital or digitised in an analogue to digital convertor.

Again, in this arrangement line 54 carried by the reel 56 is connected to a compressed gas cylinder 104 coupled by a valve 106 directly to the surface marker buoy 52. As with the arrangement already described a release pin 58 normally holds cover part 60 in position.

Within the logic circuitry 100 the output of flow meter 102 is fed to a register 108 in a sense to increase the count value therein. Register 108 also receives a signal from an pulse generator 110 which acts in a sense to decrease the count value of the register.

A monitoring device 112 monitors the count value of register 108 and if that value is zero for a predetermined period (determined by a clock 114) causes actuation of valve 106 and the release of pin 58.

As before this allows the cover part 60 to detach itself from the device and the surface marker buoy 52 to inflate.

The surface marker buoy will therefore rise and carry with it compressed gas cylinder 104. In doing this line 54—which is coupled to the compressed gas cylinder 104—will be unreeled from the reel 56 allowing an indication to be given that the diver wearing the device is in need of assistance. Again the device is provided with switches 32, 40 and 42 preventing its operation at depths of less than 2 m, disabling its operation if the diver so wishes and enabling the diver to trigger its operation should he so desire.

As noted above the surface marker buoys are of standard form approximately 4.5 m (15') in length and requiring approximately 0.6 $m^3$ ($20'^3$) of air to be completely inflated depending upon the depth. The buoy is fitted with a pressure relief valve to ensure it does not burst before it reaches the surface.

In each of the arrangements so far described the device embodying the invention is shown fitted between the scuba first stage 16 and the high pressure hose 20 of the divers breathing apparatus. Such an arrangement may not be desired by all divers.

It is alternatively possible to separate the transducer (be it a pressure gauge or flow rate meter) from the rest of the device and connect the transducer to the rest of the device by a flexible coupling.

Such an arrangement is shown in FIG. 3 in which the transducer 130 is connected by a flexible coupling to the body of the device 134. The transducer 130 also has associated with it the switches 40 and 42 which enable the diver to disable or trigger the device. The output of transducer 130 is digital or digitized by an analogue to digital convertor.

The output to the transducer 130 is fed to by the flexible coupling 132 to logic circuitry in a part 136 of the body of the device. Transducer 130, be it a flow rate monitor or a gas pressure monitor is desirably electrically coupled to the logic circuitry in part 136 of the device by an electrical cable.

In other respects the device is similar to that described above with reference to FIG. 1, save that in the arrangement of FIG. 3 the servo mechanism 36 and tap 44 for controlling the flow of gas from the gas bottle 46 has been replaced by solenoid valve 138. Thus when the device is triggered solenoid valve 138 opens coupling the gas bottle 46 to the control valve (not shown) of the surface marker buoy 52 under the control of the logic circuitry in part 136 of the device.

Again the arrangement of FIG. 3 differs from that described in the earlier examples in that the lid part 142 that part of the body 134 of the device housing the surface marker buoy, reel 56 and line is a simple friction fit in the device. The lid part 142 being provided with four feet 144 as shown for frictionally engaging side walls 146 of that part of the device body.

If desired, and if the transducer is a gas pressure gauge, it may be located in part 136 of the body 134 of the device and the active transducer 130 shown in FIG. 3 be replaced with a simple connection to the divers breathing system. In this case the flexible connection would comprise a flexible gas tight hose (and electrical leads connecting the switches 40 and 42 back to the logic circuitry).

The logic circuitry utilised in the arrangement of FIG. 3 may be as described above with reference to FIGS. 1 or 2 or varied as follows.

One form of the logic circuitry (assuming the transducer 130 is arranged to generate an electrical signal) is to use that signal as an input to a first register in a sense to increase the count value thereof and at predetermined intervals (for example 2 minutes) compare the count value of the register with a pre-set value (held for example in a second register). If, when compared the count value of the first register is less than the pre-set value then the device would be triggered and the surface marker buoy inflated; whilst if the count in the first register is greater than or equal to the pre-set value held in the second register the first register would be re-set to zero.

It is envisaged that the pre-set value would be set at the factory where the device is manufactured, but could be varied if a diver so required.

Alternatively, the output of transducer may be fed to a register in the logic circuitry in a sense to increase the count value of the register and the count value of the register be monitored at pre-set time intervals. If, when checked, the count value of the register is non-zero the register would be reset to zero, whilst if the count in the register were zero the device would be triggered and inflation of the surface marker buoy initiated.

It is envisaged that the arrangement shown in FIG. 3 the transducer would probably be a gas flow monitor located in the re-breather, probably the mouth piece or demand outlet, from the main part of the divers gas supply.

Other ways of monitoring whether or not a diver is breathing can be incorporated in devices embodying the invention, and two such monitors, which operate electro-mechanically, are shown in FIGS. 4 and 5.

The monitor shown in FIG. 4 monitors the high pressure gas supply in the divers breathing apparatus and comprises a housing 150 divided into upper 152 and lower 154 chambers by a flexible, gas tight diaphragm 156. Sealed to the diaphragm 156 is a hollow piston rod 158 open at its lower end (as viewed in the Figure) 160 and with an aperture 162 in that part of its length lying in the chamber 152. Piston rod 158 carries a plate piston 164 driven by a light spring 166 to seat on an annular shoulder 168 defining the boundary of the gas inlet 170 and the lower chamber 154.

The top wall of the top chamber 152 supports a normally open micro-switch 172 which when closed re-sets a timer 174. The timer 174 is arranged, if not re-set, after a pre-determined interval of say 2 minutes to actuate a solenoid valve 176 causing inflation of the surface marker buoy in the device (not shown). Operation of the monitor shown in FIG. 4 is as follows.

High pressure gas is fed to the inlet 170 and passes into the lower chamber 152 passing around the piston 164. The high pressure gas also passes along the hollow piston rod 158 to the upper chamber 152. As soon as the pressures in the upper and lower chambers 152 and 154 equalises piston 164 is driven by the light spring 166 to engage the shoulder 168 thus sealing the lower chamber 154.

In time the pressure at the inlet 170 will fall (due to the divers breathing) which will have the effect of reducing the pressure in the upper chamber 152 compared to the pressure in the lower chamber—between the diaphragm 156 and the piston 164. The flexible diaphragm 156 begins to be flexed upwardly by this pressure difference, carrying the piston rod 158 with it until the upper end of the piston rod 158 contacts and closes the micro-switch 172 re-setting the timer 174. Piston 164 is at this time lifted from the shoulder 168 allowing the pressure in the upper and lower chambers 152 and 154 to equalise and return the diaphragm to its normal unflexed position. The piston 164 is again biased into contact with the shoulder 168 and the sequence begins to repeat.

It will be appreciated that if the diver ceases to breath there will be no change over time in the gas pressure applied to the inlet 170 and therefore no change in difference between pressure in the upper and lower chambers 152 and 154. The diaphragm 156 in this case will not be flexed and the piston rod 158 will not close micro-switch 172. Thus after a pre-set interval the solenoid valve 176 will be actuated by timer 174 and the surface marker buoy inflated.

A second electro-mechanical arrangement is illustrated in FIG. 5 for forming the monitor and is shown to comprises a body 180 having an inlet 182 leading to a first, lower, chamber 184 separated from a second, upper, chamber 186 by a wall 188 having two apertures closable by poppet valves 190 and 192.

Valve 190 is carried in a perforated valve guide 194 within the upper chamber 186 and is driven to close by a spring 196 acting between the valve head and the fixed spring plate 198.

Valve 192 is located within chamber 184 and is again carried in a perforated valve guide 200.

Valve 192 is driven to close by a spring 202 acting between the valve head and a spring plate 204 the position of which may be adjusted along the valve guide. Stem 206 of the valve 192 extends through the adjustable spring plate 204 and is located above a second plate 208 carried in the perforated valve guide carrying a micro-switch 210. The position of plate 208 may also be adjusted along the length of valve guide 206. Micro-switch 210 is, again, normally open and when closed acts re-set a timer 212 controlling operation of a solenoid valve 214.

Operation of the monitor is as follows. The inlet 182 is coupled to the high pressure side of the divers breathing apparatus and gas is fed to the lower chamber 184. The gas also passes (via the valve 190) to the upper chamber 186. As the pressure equalises valve 190 is closed under the influence of spring 196.

As the diver continues to breath the pressure in the lower chamber 184 falls and so the pressure in the upper chamber 186 becomes increasingly greater than that in the lower 184. This has the effect of driving valve 192 to open. The time before valve 192 will open will depend upon the setting of the adjustable spring plate 204 within the perforated valve guide 200. When valve 192 does open however, its stem 206 is carried into contact with the micro-switch 210 which is closed and in turn re-sets the timer 212. At the same time the pressures in the chambers 186 and 184 equalise—at the pressure of the inlet 182—and valve 192 is driven closed.

It will be appreciated that if the diver ceases to breath there will be no change over time in the gas pressure applied to the inlet 182 and therefore no change in difference between pressure in the chambers 184 and 186. The valve 192 in this case will not be driven to open and its the stem 206 will not close micro-switch 210. Thus after a pre-set interval the solenoid valve 214 will be actuated by timer 212 and the surface marker buoy inflated.

I will be appreciated that various other modifications may be made to the described arrangements without departing from the scope of the invention, in particular it may be provided that the surface marker buoy is fitted with a radio beacon operable, when it reaches the surface, to give a broadcast indication of the position of the diver.

Additionally or alternatively, the surface marker buoy and/or the diver may have attached to it and/or him a marker dye release mechanism allowing the position of the buoy and/or the diver to be readily seen from the air should it so be wished.

It will be seen from the above that the invention provides a safety device for divers usable with open or closed circuit breathing apparatus and which will provide a ready indication to those on the surface that the diver is in difficulty.

Furthermore the device may be formed as an integral part of the divers breathing equipment or be physically separate from it and connected to it by a flexible coupling.

Other modifications to the described arrangements will be seen by those skilled in the art of the invention.

I claim:

1. A safety device to be worn by a diver the device comprising a surface marker buoy, a line operatively coupling the surface marker buoy to the diver, means for inflating the surface marker buoy including a store of compressed gas for the surface marker buoy, means for monitoring the diver's breathing which upon detecting the diver has stopped breathing is operable to cause the inflating means to inflate the surface marker buoy, an electronic register for holding a first count value, timer means and means for holding a second value, wherein the diver's breathing monitoring means includes a transducer the output of which is fed to said register in a sense to increase the count value held therein, the device further including a comparator operable to compare at pre-set intervals determined by the timer the first count value with the second value.

2. A device as claimed in claim 1, further including a second register, wherein the comparator is operable to compare the count value of the first mentioned register with that held in the second register and, if when compared those values differ by more than a pre-determined amount, generate a first output causing the value of the count in the first mentioned register to be read into said second register or, if when compared those values differ by less than said pre-determined amount, to cause said inflating means to inflate said surface marker buoy.

3. A device as claimed in claim 1, wherein comparator means is operable to compare the count value of the said register with zero and, if when compared the count value of said register is equal to or greater than a predetermined count, to generate a first output causing the count value of said register to be re-set to zero or, if when compared the count value in said register is less than said pre-determined count, to cause the inflating means to inflate the surface marker buoy.

4. A device as claimed in claim 1, wherein there is further provided a pulse generator the output of which is fed to said register in a sense to decrease the count therein and wherein said comparator means is operable to compare the count value of said register with a pre-set value and, if when compared the count value of said register is less than said pre-set value, to cause the inflating means to inflate the surface marker buoy or, if when compared the count value of the register is equal to or greater than said pre-set value, to cause said register to be re-set to a zero count value.

5. A device as claimed in claim 2, wherein said transducer monitors the pressure of stored gas being breathed by the diver.

6. A device as claimed in claim 2, wherein said transducer monitors the flow of gas passed to the diver.

7. A device as claimed in claim 2, wherein said transducer monitors the flow of gas exhaled by the diver.

8. A device as claimed in claim 1, wherein the diver's breathing monitoring means monitors the pressure of gas supplied to the diver and comprises first and second chambers to which the gas supplied to the diver is coupled, valve means being provided to separate the chambers when the gas pressure in them is equal, the device further including timer means operable after a pre-determined interval to cause the inflating means to inflate the surface marker buoy and switch means actuation of which reset the timer means, and wherein a difference in pressure between said two chambers causes movement of the valve means to actuate said switch means.

9. A device as claimed in claim 1, further including a cover for the surface marker buoy and cover release means actuated when the diver's breathing monitoring means detects the diver has stopped breathing.

10. A device as claimed in claim 1, wherein said line coupling the surface marker buoy to the diver has a breaking strain sufficient to enable the diver to be pulled to the surface.

11. A device as claimed in claim 1, further including a radio beacon which is actuated when the surface marker buoy is inflated.

12. A device as claimed in claim 1, further including a container of a marker dye which is opened when the surface marker buoy is inflated.

13. A device as claimed in claim 1, further including a pressure switch operable to disable operation of the device until the diver has submerged to a pre-determined depth.

14. A device as claimed in claim 1, further including manually operable switch means for preventing operation of the device.

15. A device as claimed in claim 1, further including manually operable switch means to trigger operation of the device.

16. A safety device to be worn by a diver the device comprising a surface marker buoy, a line operatively coupling the surface marker buoy to the diver, an inflation device to inflate the surface marker buoy including a store of compressed gas for the surface marker buoy, a monitoring device to monitor the diver's breathing which upon detecting the diver has stopped breathing is operable to cause the inflation device to inflate the surface marker buoy, an electronic register for holding a first count value, a timer and a mechanism adapted to hold a second value, wherein the diver's breathing monitoring device includes a transducer the output of which is fed to said register in a sense to increase the count value held therein, the device further including a comparator operable to compare at pre-set intervals determined by the timer the first count value with the second value.

* * * * *